US011110729B2

(12) United States Patent
Yasui

(10) Patent No.: US 11,110,729 B2
(45) Date of Patent: Sep. 7, 2021

(54) RECORDING MEDIUM AND METHOD FOR ACQUIRING LANDING DEVIATION AMOUNT IN RECORDING APPARATUS

(71) Applicant: SEIKO EPSON CORPORATION, Tokyo (JP)

(72) Inventor: Masashi Yasui, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/564,005

(22) Filed: Sep. 9, 2019

(65) Prior Publication Data

US 2020/0079125 A1 Mar. 12, 2020

(30) Foreign Application Priority Data

Sep. 10, 2018 (JP) ..... JP2018-168517

(51) Int. Cl.
*B41J 29/393* (2006.01)

(52) U.S. Cl.
CPC ..... *B41J 29/393* (2013.01)

(58) Field of Classification Search
CPC ..... B41J 2/17593; B41J 2/125
See application file for complete search history.

(56) References Cited

U.S. PATENT DOCUMENTS 6,312,082 B1 * 11/2001 Lund ..... B41J 2/125 347/100
2003/0020776 A1 * 1/2003 Franzke ..... H04N 1/4078 347/19
2010/0198504 A1 8/2010 Samsalovic et al.
2011/0249051 A1 * 10/2011 Chretien ..... B41J 2/17593 347/14
2018/0036949 A1 * 2/2018 Lopez ..... B29C 64/112

FOREIGN PATENT DOCUMENTS

JP 2008-143044 A 6/2008
JP 2010-175546 A 8/2010
JP 2012-035446 A 2/2012

* cited by examiner

*Primary Examiner* — Lam S Nguyen
(74) *Attorney, Agent, or Firm* — Global IP Counselors, LLP

(57) ABSTRACT

Provided is a recording medium having a test pattern recorded thereon, the test pattern being used for acquiring a landing deviation amount of a recording apparatus including a discharge unit configured to discharge a transparent ink, wherein when light is radiated to be incident on a surface of the recording medium at an incident angle of 45 degrees, and lightness of reflected light from the test pattern recorded with the transparent ink and lightness of reflected light from the recording medium are measured, with each of the lightness being measured at a position perpendicular to the surface, a difference in lightness between the reflected light from the test pattern and the reflected light from the recording medium is equal to or greater than a value predetermined, based on a type of the recording medium.

4 Claims, 7 Drawing Sheets

RECORDING MEDIUM AND METHOD FOR ACQUIRING LANDING DEVIATION AMOUNT IN RECORDING APPARATUS

The present application is based on, and claims priority from JP Application Serial Number 2018-168517, filed Sep. 10, 2018, the disclosure of which is hereby incorporated by reference herein in its entirety.

BACKGROUND

1. Technical Field

The present disclosure relates to a recording medium and a method for acquiring a landing deviation amount in a recording apparatus.

2. Related Art

In a recording apparatus such as a printer, a transparent ink may be used in addition to colored inks such as cyan, magenta, yellow, and black inks. In the recording apparatus, when mounting positions of heads configured to discharge respective colored inks are deviated, a landing deviation of ink may occur depending on a particular discharged colored ink. Therefore, a registration adjustment may be performed for detecting a landing deviation for each of the colored inks and correcting a landing position of the ink based on the deviation amount.

As with the colored ink, the transparent ink is discharged from a nozzle of a discharge head and lands on a recording medium. Therefore, as with the colored ink, it is preferable that the registration adjustment is performed for the transparent ink. However, due to low brightness of light reflected on the transparent ink, it is difficult to detect a landing deviation of the transparent ink. For example, JP-A-2012-35446 discloses a technology in which a test pattern printed with a transparent ink is irradiated with light, and the resultant specularly reflected light is received by a measurement device to detect the landing position of the transparent ink to perform a registration adjustment.

Image scanners based on known technologies, for example, some existing image scanners configured not to receive specularly reflected light for acquiring an image cannot detect a test pattern printed with a transparent ink, and thus, such scanners may not be used as a measurement device for registration adjustment. Therefore, there is a need for technology for detecting, by an existing image scanner, a test pattern printed with a transparent ink.

SUMMARY

According to an aspect of the present disclosure, provided is a recording medium having a test pattern recorded thereon, the test pattern being used for acquiring a landing deviation amount in a recording apparatus including a discharge unit configured to discharge a transparent ink. In the recording medium, when light is radiated to be incident on a surface of the recording medium at an incident angle of 45 degrees, and lightness of reflected light from the test pattern recorded with the transparent ink and lightness of reflected light from the recording medium are measured, with each of the lightness being measured at a position perpendicular to the surface, a difference in lightness between the reflected light from the test pattern and the reflected light from the recording medium is equal to or greater than a predetermined value based on a type of the recording medium.

DESCRIPTION OF EXEMPLARY EMBODIMENTS

A. First Embodiment

Figure 1:
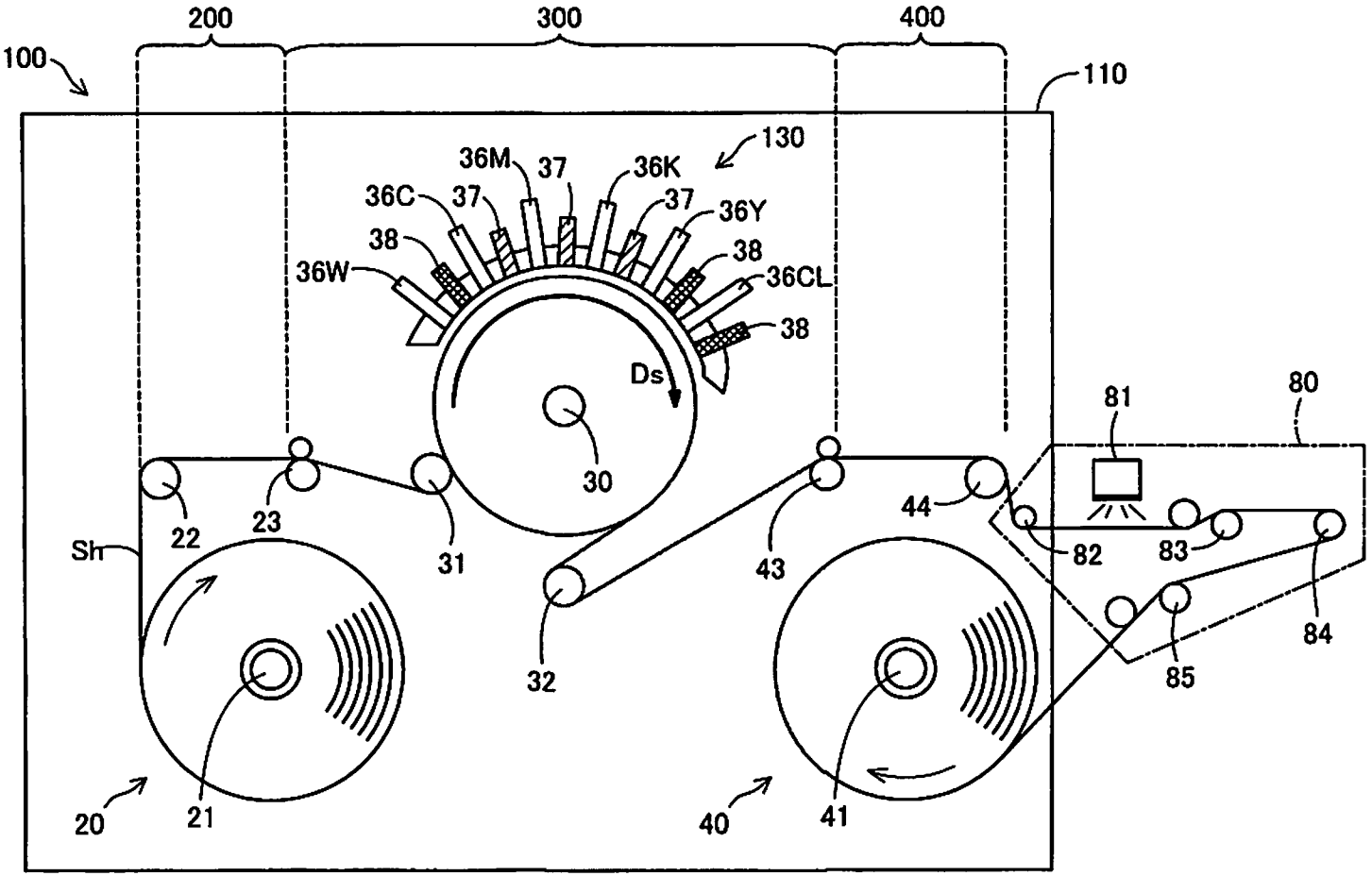
FIG. 1 is a schematic diagram illustrating a schematic configuration of a printing apparatus according to an embodiment.

FIG. 1 is a schematic diagram illustrating a schematic configuration of a printing apparatus 100 according to an embodiment. The printing apparatus 100 is an inkjet printer for performing printing onto a long shape printing medium Sh provided as a wound roll. The printing is performed on the printing medium Sh being wound on the outer peripheral surface of a rotary drum 30 in a process unit 300. The printing apparatus 100 includes, in an internal space of a housing 110, a feeding unit 200 configured to feed the printing medium Sh, the process unit 300 configured to discharge ink for printing, and a winding unit 400 configured to dry the ink on the printed printing medium Sh and wind the printed printing medium Sh. In the embodiment, a light irradiation unit 80 to be mounted as an external optional unit is connected to the winding unit 400.

First, transport of the printing medium Sh will be described. Prior to printing, the printing medium Sh wound on a feeding roller 21 to form a roll is attached to a feeding shaft 20. A medium that can be used for the printing medium Sh is a paper-based printing medium or a film-based printing medium. Examples of the paper based printing medium include high-quality paper, cast paper, art paper, coated paper, and the like. Examples of the film-based printing medium include synthetic paper, polyethylene terephthalate (PET), polypropylene (PP), and the like. In printing in the embodiment, in addition to the printing medium Sh, a test printing medium Ts, as described later, for observing a landing deviation amount is also used.

The printing medium Sh is fed as the feeding shaft 20 rotates, and then the transport direction of the fed printing medium Sh is changed by a roller 22. Further, the printing medium Sh is transported to the process unit 300 by a transport roller 23. After transported to the process unit 300, the printing medium Sh is caused to adhere to the outer peripheral surface of the rotary drum 30 by a roller 31 provided in contact with the outer peripheral surface of the rotary drum 30. The printing medium Sh wound on the outer peripheral surface of the rotary drum 30 is transported as the rotary drum 30 rotates. The printing medium Sh is transported by a distance corresponding to about ¾ of the outer circumference of the rotary drum 30. Then, the printing medium Sh is separated from the rotary drum 30 by a separating roller 32 and transported to the winding unit 400.

The printing medium Sh is further transported by a transport roller 43 of the winding unit 400, and then the transport direction of the printing medium Sh is changed by a roller 44. In the embodiment, a roller 82 of the light irradiation unit 80 further changes the transport direction of the printing medium Sh to guide the printing medium Sh into the light irradiation unit 80. The light irradiation unit 80 further includes a third light irradiator 81 and a plurality of rollers 83, 84, and 85 configured to transport the printing medium Sh. After transported via the plurality of rollers 83, 84, and 85, the printing medium Sh leaves the light irradiation unit 80 and then is wound onto a winding roller 41 to be rotated by a winding shaft 40. When the light irradiation unit 80 is not included, the printing medium Sh of which transport direction has been changed by the roller 44 may be wound on the winding roller 41 without being subject to any intervening processing.

In the process unit 300, a printing head 130 discharges inks onto the surface of the printing medium Sh transported as described above. Specifically, while supporting, by means of the rotary drum 30, the printing medium Sh fed from the feeding unit 200, the process unit 300 prints an image on the supported printing medium Sh by discharging a plurality of inks from the printing head 130 disposed along the outer peripheral surface of the rotary drum 30. The separating roller 32 and the rotary drum 30 support the printing medium Sh and transport the printing medium Sh in the transport direction Ds.

Figure 2:
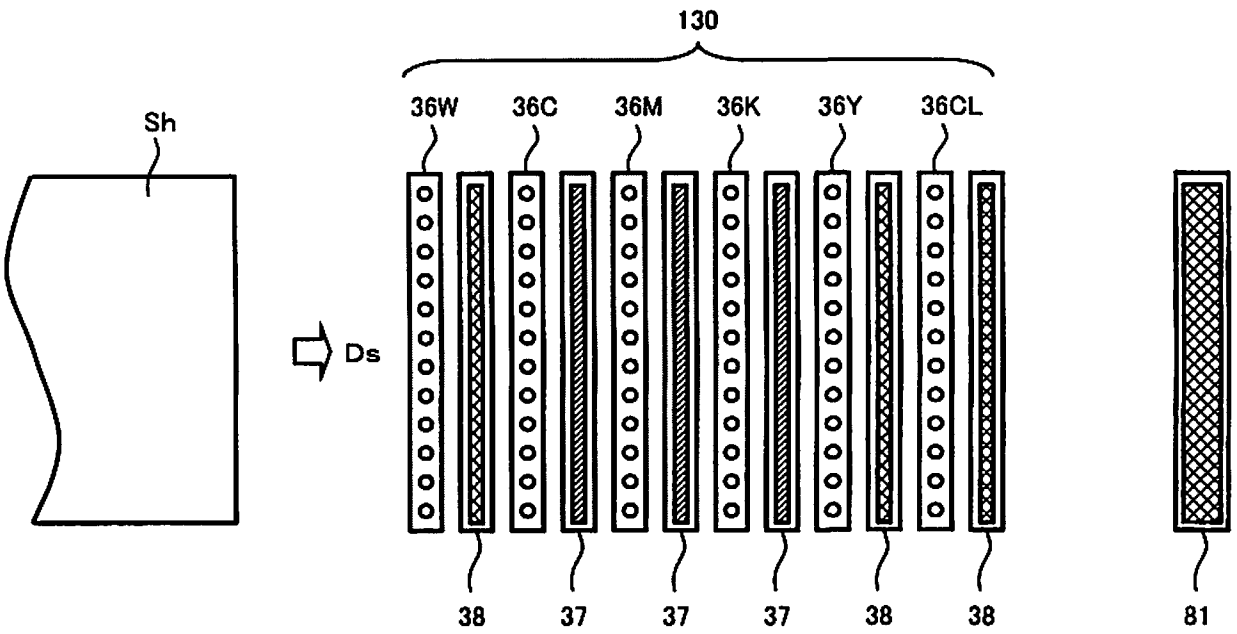
FIG. 2 is an explanatory diagram illustrating an arrangement of nozzle rows and light irradiators in a printing head.

FIG. 2 is an explanatory diagram illustrating an arrangement of nozzle rows 36 and light irradiators 37 and 38 in the printing head 130. More specifically, FIG. 2 is a bottom view of the nozzle rows 36 of the printing head 130 as viewed from the rotary drum 30 side. Here, for convenience of illustration, each of the nozzle rows 36 illustrated in the figure includes fewer nozzles than in the actual implementation. In the embodiment, each of the nozzle rows 36 includes a single head. Nozzles in each of the nozzle rows 36 are arranged along the axial direction of the rotary drum 30. Examples of the printing head 130 that can be used include a type of inkjet printing head including a driving element such as a piezoelectric element and inks contained in ink chambers, and configured to flex a vibration plate as the driving element deforms to discharge the inks from nozzle holes.

The printing head 130 includes a plurality of nozzle rows 36W, 36C, 36M, 36K, 36Y, and 36Op. The nozzle rows 36W, 36C, 36M, 36K, 36Y, and 36Op are configured to discharge a white ink W, a cyan ink C, a magenta ink M, a black ink K, a yellow ink Y, and a transparent ink Op, respectively. The transparent ink Op is colorless and is used to impart gloss to the printed material. The transparent ink Op may be used in pretreatment for the printing with the colored ink. Note that, the cyan ink C, the magenta ink M, the black ink K, and the yellow ink Y are collectively referred to as "colored inks". When there is no need to distinguish among the nozzle rows for the six inks, the nozzle rows are referred to as "nozzle rows 36". The plurality of nozzle rows 36 are arranged in the aforementioned order along the outer peripheral surface of the rotary drum 30, and face the surface of the printing medium Sh with a predetermined gap between the nozzle rows and the surface. When the ink from each of the plurality of nozzle rows 36 is discharged, the ink lands on the printing medium Sh to form ink dots on the printing medium Sh, and thus, a color image is printed.

A photocurable ink curable by irradiation of light may be used in the nozzle rows 36. In the embodiment, a UV ink curable by ultraviolet light is used. The printing head 130 includes first light irradiators 37 and second light irradiators 38 configured to cure ink discharged onto the printing medium Sh. The first light irradiators 37 and the second light irradiators 38 are configured to irradiate, with ultraviolet rays, the printing medium Sh on the rotary drum 30. The second light irradiators 38 are configured to provide light of higher intensity than the first light irradiator 37.

Along a feeding direction Ds of the printing medium Sh, the first light irradiator 37 is disposed immediately downstream from each of the nozzle rows 36C, 36M, and 36K configured to discharge the cyan ink C, the magenta ink M, and the black ink K, respectively. The second light irradiator 38 is disposed immediately downstream from each of the nozzle rows 36W, 36Y, and 36Op configured to discharge the white ink W, the yellow ink Y, and the transparent ink Op, respectively. Generally, the higher the intensity of light irradiating a photocurable ink is, the more quickly the ink cures. Even when the white ink W is overlaid with the transparent ink Op in printing, the arrangement in which the second light irradiator 38 configured to provide light of higher intensity than the first light irradiator 37 is disposed immediately downstream from each of the nozzle rows 36W and 36Op ensures sufficient curing of the underlying ink. Further, the first light irradiators 37 disposed immediately downstream from each of the nozzle rows 36C, 36M, and 36K allows for temporary curing of the inks to prevent ink bleed. Once discharging of the cyan ink C, the magenta ink M, the black ink K, and the yellow ink Y onto the printing medium Sh is completed, all the inks are cured by the second light irradiator 38 disposed immediately downstream from the nozzle row 36Y. However, any type of light irradiator selected from the light irradiators 37 and 38 may be disposed immediately downstream each of the nozzle rows 36 depending on the characteristics of the ink. In addition, instead of using both types of the light irradiators (i.e., light irradiators 37 and 38), the same type of light irradiator may be disposed immediately downstream from each of the nozzle rows 36. Furthermore, some of the light irradiators provided immediately downstream from the nozzle rows 36 may be omitted. However, it is preferable to provide the light irradiator immediately downstream from each of the nozzle rows 36 in order to achieve somewhat quicker curing of the inks to stabilize the dots.

The third light irradiator 81 of the light irradiation unit 80 described above is disposed further downstream from the second light irradiator 38 disposed immediately downstream from the nozzle row 36Op configured to discharge the transparent ink Op. The third light irradiator 81 is configured to additionally irradiate the printed material printed by the printing head 130 with light to ensure further curing of the inks. However, the third light irradiator 81 can be omitted.

Figure 3:
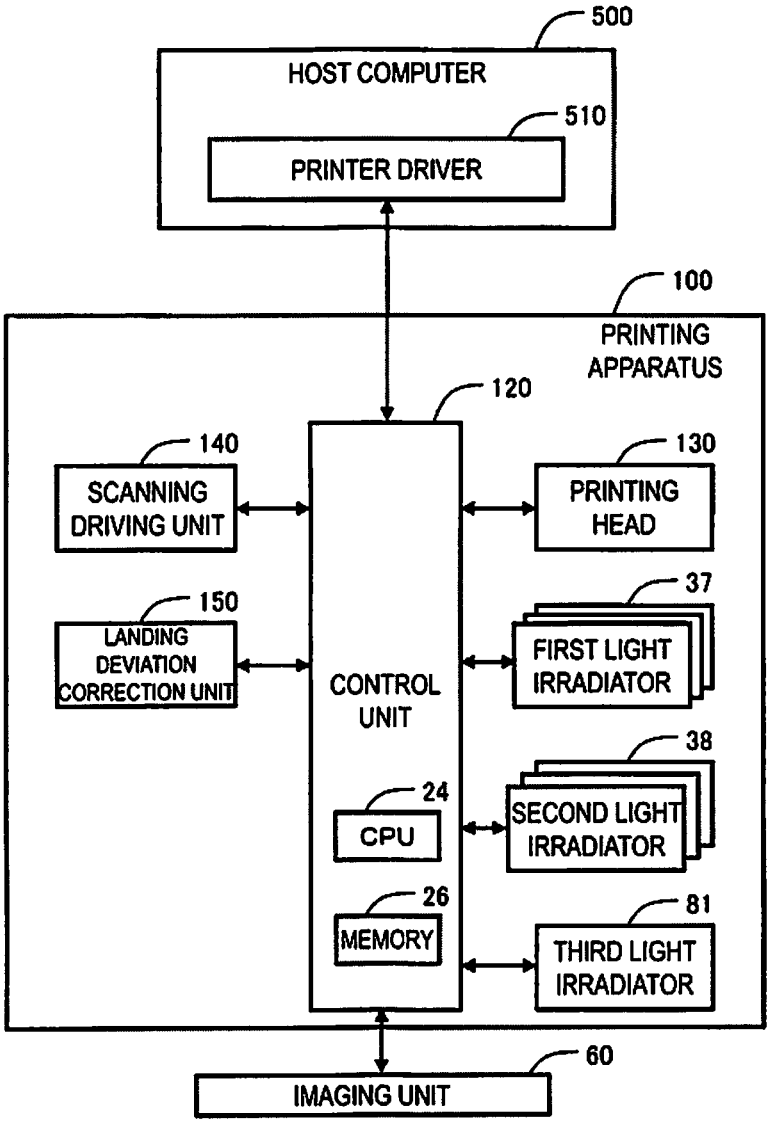
FIG. 3 is a block diagram illustrating functions of the printing apparatus.

FIG. 3 is a block diagram illustrating functions of the printing apparatus 100. A printing system includes the printing apparatus 100, a host computer 500, and an imaging unit 60. The printing apparatus 100 is configured to use print data supplied by a printer driver 510 of the host computer 500 to perform printing on the printing medium Sh. The printing apparatus 100 includes a control unit 120, a scanning driving unit 140, and a landing deviation correction unit 150 in addition to the printing head 130 and the light irradiators 37, 38, and 81. The imaging unit 60 is described in detail later.

The control unit 120 includes a CPU 24 and a memory 26, and is configured to administrate overall control of the printing apparatus 100. The memory 26 is configured to store a program for performing printing processing and for achieving various functions of the scanning driving unit 140 and the landing deviation correction unit 150 to be performed by the CPU 24. The scanning driving unit 140 is a drive mechanism configured to drive the rotary drum 30 and rollers illustrated in FIG. 1 to drive the printing medium Sh in the paper feeding direction Ds. The landing deviation correction unit 150 has a function to correct a landing deviation amount between the nozzle row 36Op of the transparent ink and the nozzle row of the colored ink, when there is a landing deviation relating to the nozzle rows 36 of the printing head 130, as described below.

Figure 4:
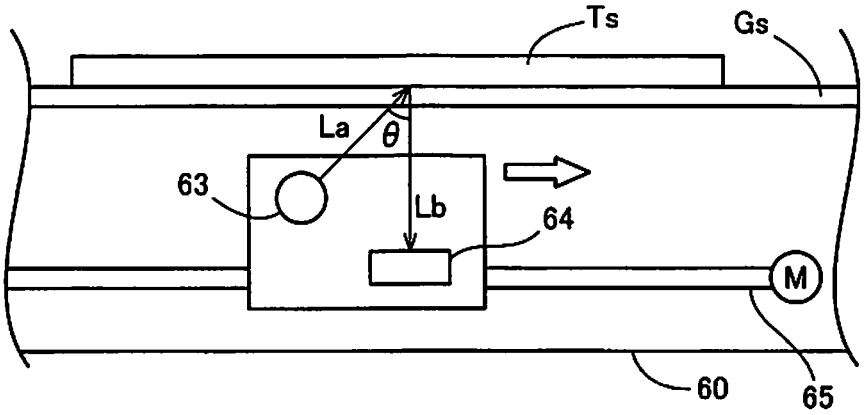
FIG. 4 is an explanatory diagram schematically illustrating an imaging unit.

FIG. 4 is an explanatory diagram schematically illustrating the imaging unit 60. The imaging unit 60 is a flat head scanner used to acquire a test pattern image on the test printing medium Ts. The test printing medium Ts is a printing medium used to acquire a landing deviation amount described below. The imaging unit 60 includes a glass plate Gs on which a document is placed, a light emitting unit 63, a light-receiving unit 64, and a transport mechanism 65. The light emitting unit 63 includes a LED light source configured to emit visible light, and a lens and a diaphragm, and is configured to irradiate the test printing medium Ts placed on the glass plate Gs with parallel light La incident at an angle θ=45 degrees. The light-receiving unit 64 is an image sensor configured to detect reflected light from a surface of the test printing medium Ts. When the normal direction with respect to the surface of the test printing medium Ts is defined as a direction of an angle of 0 degrees, the light-receiving unit 64 receives reflected light Lb at an angle of 0 degrees to acquire an image of the test printing medium Ts. Since the light emitting unit 63 irradiates the test printing medium Ts with the light incident at an angle θ=45 degrees, the light-receiving unit 64 does not receive specularly reflected light. The imaging unit 60 in the embodiment is separate from the printing device 100, but may be integrated with the printing apparatus 100. The image information acquired by the imaging unit 60 is transmitted to the control unit 120.

Figure 5:
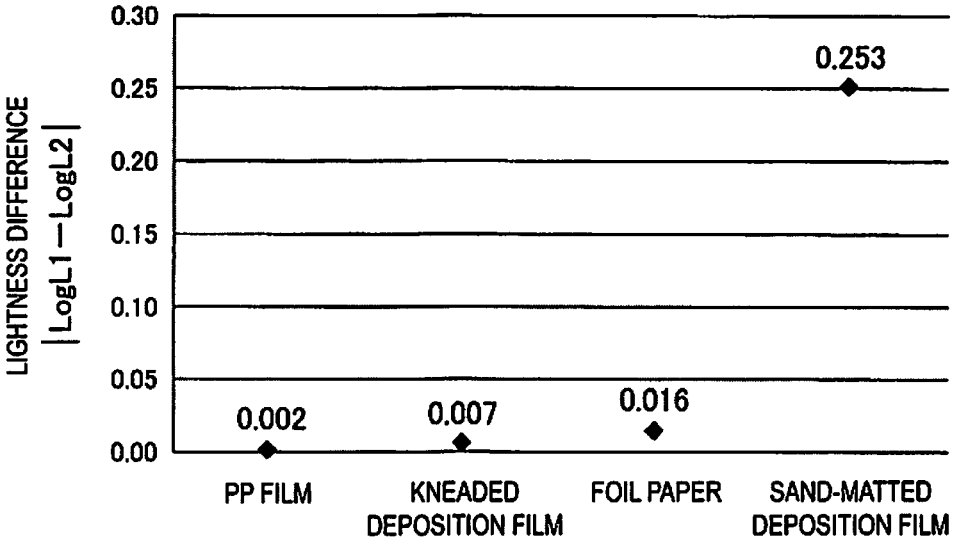
FIG. 5 is a graph of test results of a lightness difference of reflected light in various printing media.

Next, with reference to FIG. 5, a relationship between lightness and the printing medium used in the embodiment for detecting a landing deviation amount of an ink will be described. FIG. 5 is a graph of test results of a lightness difference of reflected light in various printing media samples. A lightness measuring instrument for testing is used to acquire the lightness of reflected light. "Lightness" refers to the lightness component defined in the CIELab color space. A solid test area painted with the transparent ink is formed on a part of a surface of a printing medium sample. Similarly to the image acquisition method performed by the imaging unit 60, the lightness measuring instrument is configured to irradiate the surface of the printing medium sample with light incident at an angle of 45 degrees, and detect lightness of reflected light from a surface of the printing medium not painted with the transparent ink and lightness of reflected light from the solid area painted with the transparent ink.

Four types of samples, i.e., a PP film, foil paper, a kneaded vapor-deposited film, and a sand-matted vapor-deposited film, are used for printing medium samples. The "foil paper" is a laminated sheet in which aluminum foil is laminated with pulp paper. The foil paper may include a sheet on which aluminum is vapor-deposited in vacuum. The "vapor-deposited film" refers to a film made of plastic such as polyester, polypropylene, or nylon, on which a thin layer of metal such as aluminum, silicon oxide, or alumina is formed by a vacuum vapor-deposition method. "Kneading" refers to a process of kneading a matting agent used for kneading into a film. "Sand-matting" is a process in which sandblasting is used to roughen a surface of a film.

When a lightness L1 is the lightness of the reflected light from the solid area painted with the transparent ink and a lightness L2 is the lightness of the reflected light from a surface of a printing medium sample on which the transparent ink is not discharged, the lightness difference is a calculated difference between a logarithmic function Log L1 for the lightness L1 and a logarithmic function Log L2 for the lightness L2, or is an absolute value of this calculated difference. Note that the logarithmic function Log is a natural logarithm with Napier's constant e as its base, and Napier's constant e may be omitted. A large lightness difference means high visibility of the transparent ink on the printing medium.

According to the test results, the lightness difference in the PP film is about 0.002. The lightness difference in the kneaded vapor-deposited film and the foil paper are about 0.007 and about 0.016, respectively. The lightness difference in the sand-matted vapor-deposited film is about 0.253, which is the highest value of lightness difference. Note that the results of lightness difference are rounded up to the third decimal place. As described above, the lightness difference observed for each of the printing medium samples is greater than or equal to 0.002. These values of lightness difference are greater than the lightness difference observed for plain paper, for example. Thus, when the reflected light is received at an angle of 0 degrees, as in the image detection by the imaging unit 60 as image scanner, detection of an image printed with the transparent ink in these printing medium samples is more readily performed than when such detection is performed in plain paper. The printing medium samples in which the lightness difference of 0.005 or greater is observed are particularly effective for detection of an image printed with the transparent ink. For each of the foil paper, the kneaded vapor-deposited film, and the sand-matted vapor-deposited film, the lightness difference of not less than 0.007 is observed, which is even greater than the lightness difference of the PP film. The largest lightness difference in the test results is observed for the sand-matted vapor-deposited film. The sand-matted vapor-deposited film is used for the test printing medium Ts for acquiring a landing deviation amount in the embodiment.

Figure 6:
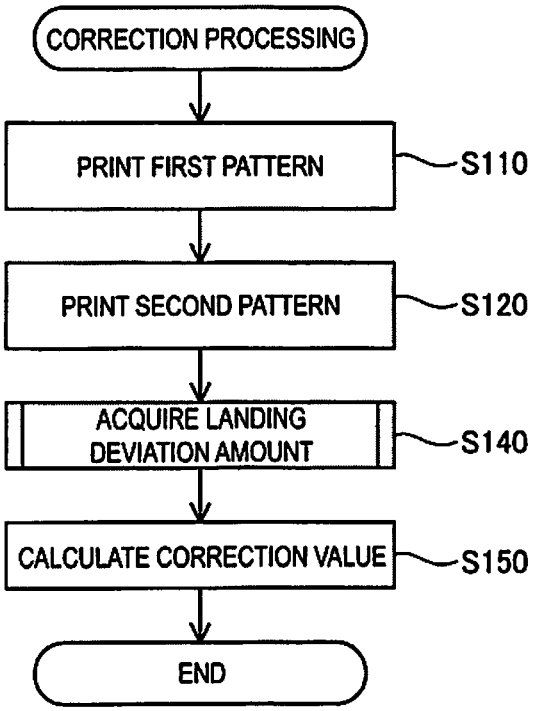
FIG. 6 is a flowchart illustrating correction processing to be performed by a control unit of the printing apparatus.

Next, correction processing using the sand-matted vapor-deposited film will be described using FIGS. 6 to 8. FIG. 6 is a flowchart illustrating the correction processing to be performed by the control unit 120 of the printing apparatus 100. The CPU 24 reads programs corresponding to various functions stored in the memory 26 to perform various control by the control unit 120. The correction processing is processing for correcting landing deviations of the transparent ink. The correction processing is performed, for example, immediately after the start of the printing processing in response to a user operation on the printing apparatus 100. The test printing medium Ts and a test pattern 50 including a first pattern Pt1 and a second pattern Pt2 are used in the correction processing.

In the correction processing according to the embodiment, control for correcting ink landing deviations between the print heads for respective colors in the nozzle rows 36 is performed. In the printing apparatus 100 according to the embodiment, deviations of the ink landing position between the nozzle rows for colored inks, i.e., the nozzle rows 36 other than the nozzle row 36Op for the transparent ink are firstly adjusted. Thereafter, the nozzle row 36Op for the transparent ink and the nozzle row 36K for the black ink are used to adjust deviations of the ink landing position for the nozzle row 36Op for the transparent ink. The nozzle row used in this adjustment is not limited to the nozzle row 36K for the black ink, and a nozzle row corresponding to another type of ink may be used. In the detection of the landing deviation amount in the printing apparatus 100, the above-described sand-matted vapor-deposited film is used as the test printing medium Ts. In addition, the test pattern 50 for detecting deviations of the ink landing position between the nozzle row 36Op for the transparent ink and a print head for a colored ink is formed on the vapor-deposited film.

Next, the test pattern 50 will be described. FIG. 7 is a front view of the test pattern 50 for detecting a landing deviation amount of ink, and the test pattern 50 is formed on the test printing medium Ts. The landing deviation amount of ink refers to a deviation amount of the landing position of the transparent ink with respect to a landing position of a colored ink. The test pattern 50 includes a first pattern Pt1 formed with the black ink and a second pattern Pt2 formed with the transparent ink. The first pattern Pt1 includes a plurality of ruled line pairs Lp including two ruled lines. The second pattern Pt2 includes a plurality of ruled lines Ln. The ruled line Ln is formed to have the lateral width substantially equal to the gap distance in the ruled line pair Lp in the first pattern Pt1. The values of "0.0" to "4.5" in FIG. 7 represent detected ink landing deviation amounts. The unit and the upper limit of the value are appropriately set according to the landing deviation amount to be measured. In the embodiment, the unit of the value is a dot, where a value of 1.0 means that the nozzle is deviated by 1 dot. In the example illustrated in FIG. 7, a ruled line Ln0 corresponding to the deviation amount "0.0" is disposed in the gap of the ruled line pairs Lp corresponding to the deviation amount "0" in the first pattern Pt1. In other words, FIG. 7 illustrates, by way of example, a state in which no ink landing deviation occurs between the first pattern Pt1 and the second pattern Pt2. As illustrated in FIG. 7, each line included in the ruled line pairs Lp in the first pattern Pt1 and the ruled line Ln in the second pattern Pt2 are oriented perpendicularly to the transport direction Ds. As a result, ink landing deviation can be used to detect ink landing deviation along the transport direction Ds.

Figure 7:
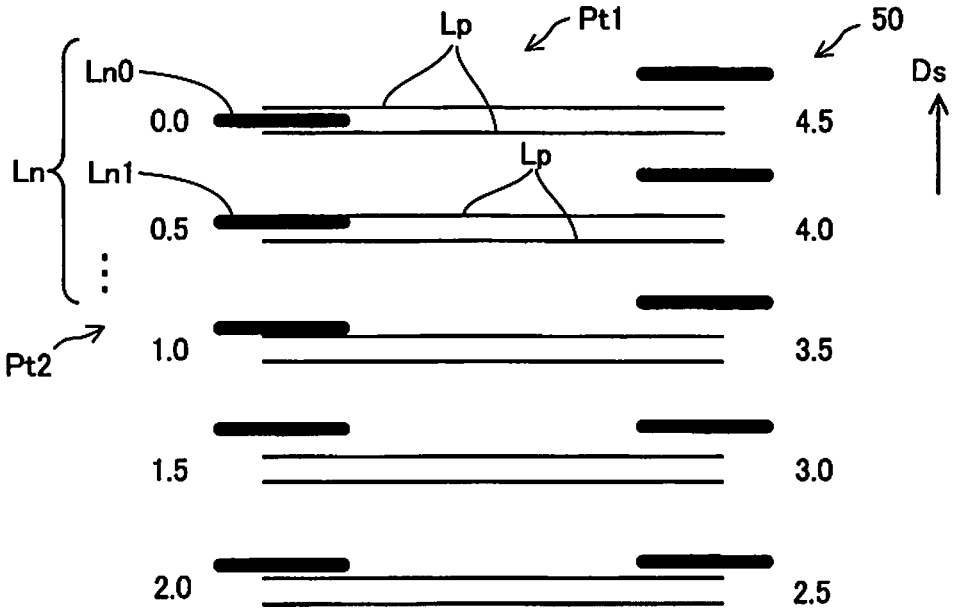
FIG. 7 is a front view of a test pattern for detecting a landing deviation amount of ink.

On the other hand, in the second pattern Pt2, the spacing between the ruled lines Ln adjacent to each other is changed stepwise in order to detect landing deviation amounts corresponding to the values of "0.0" to "4.5" in FIG. 7. The amount changed stepwise can be arbitrarily set according to the deviation amount to be measured. For example, when the ruled line Ln is positioned in the gap of the ruled line pair Lp corresponding to "1.0", the deviation amount is "1.0". As described above, by using the test pattern 50, a value corresponding to a location where the ruled line Ln is positioned in the gap of the ruled line pair Lp is detected as the landing deviation amount. Although "0.0" to "4.5" are shown in the figure, a test pattern 50 for measuring deviation amounts of 0 or less may be formed so that deviation amounts in the negative direction can be measured, and the upper limit may be 4.5 or greater.

Returning to FIG. 6, in step S110, the control unit 120 controls the nozzle row 36K for the black ink as a print head for a colored ink to form the first pattern Pt1 on the test printing medium Ts. In step S120, the control unit 120 controls the nozzle row 36Op for the transparent ink to print the second pattern Pt2 in a superposed manner on the test printing medium Ts on which the first pattern Pt1 has been formed, to complete the printing of the test pattern 50. In step S140, the control unit 120 causes the landing deviation correction unit 150 to acquire the landing deviation amount.

Figure 8:
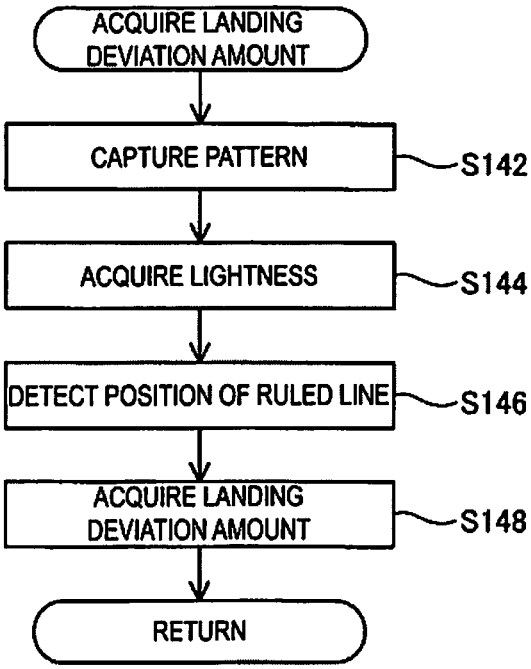
FIG. 8 is a flowchart of landing deviation amount acquisition processing to be performed by the control unit.

FIG. 8 is a flowchart of landing deviation amount acquisition processing to be performed by the control unit 120 in step S140. The landing deviation amount acquisition processing is a process for acquiring a landing deviation amount between the transparent ink and a colored ink from the test pattern 50. In step S142, the imaging unit 60 captures an image of the test pattern 50. The captured image of the test pattern 50 is transmitted to the control unit 120.

In step S144, the landing deviation correction unit 150 acquires lightness data from the image captured by the imaging unit 60. The test pattern 50 is formed on the sand-matted vapor-deposited film described above, so that the lightness difference between the test printing medium Ts and the second pattern Pt2 is increased. Thus, the landing deviation correction unit 150 can recognize the position of the second pattern Pt2 based on the lightness data, and thus, can recognize the positional relationship between the first pattern Pt1 and the second pattern Pt2. In step S146, the landing deviation correction unit 150 reads the lightness data of the test pattern 50 to acquire a position of the ruled line Ln in the second pattern Pt2 positioned in the gap of the ruled line pair Lp in the first pattern Pt1. In step S148, the landing deviation correction unit 150 acquires the landing deviation amount corresponding to the ruled line Ln based on the acquired position of the ruled line Ln and stores the acquired landing deviation amount in the memory 26.

Returning to FIG. 6, in step S150, the landing deviation correction unit 150 calculates a correction value corresponding to each of the nozzle rows 36 based on the acquired landing position deviation amount. The calculated correction value is stored in the memory 26 in a non-volatile manner. This calculated correction value can be used to perform a registration adjustment for correcting the ink landing position. This registration adjustment may be performed manually by a person and may be performed automatically by control of the printing apparatus 100.

As described above, when the lightness of the reflected light from the test printing medium Ts and the lightness of the reflected light from the test pattern 50 are measured at a position of an angle of 0 degrees, i.e., a position perpendicular to the surface of the recording medium, the sand-matted vapor-deposited film can be used for the test printing medium Ts to obtain a difference in lightness greater than or equal to when plain paper is used, for example, the difference in lightness being greater than or equal to 0.002. Therefore, the test printing medium Ts can be used to recognize the position of the transparent ink even by a type of imaging unit 60 configured to receive reflected light at a position perpendicular to the surface of the recording medium instead of receiving specularly reflected light. As a result, detection of the landing deviation amount can be automated by the imaging unit 60, and fast calculation of a correction value can be achieved.

B. Other Embodiments (B1) In the above embodiment, the test pattern 50 is used to measure landing deviations between the print heads in the paper feeding direction Ds. Regarding this, the purpose of the use of the test pattern is not limited to measuring of landing deviations in the paper feeding direction Ds. For example, by using a test pattern which has a configuration identical to the test pattern 50 rotated by 90 degrees, landing deviations in the direction perpendicular to the paper feeding direction Ds may be measured. Further, any of various test patterns for measuring relative landing deviation amounts between a colored ink and the transparent ink may be used.

(B2) In the above embodiment, the colored inks are discharged after the transparent ink is discharged. Alternatively, the transparent ink may be discharged before the colored inks are discharged. In this case, the first pattern Pt1 of a colored ink and the second pattern Pt2 of the transparent ink are printed in a superposed manner.

(B3) In the printing apparatus 100 according to the above-described embodiment, each of the nozzle rows 36W, 36C, 36M, 36K, 36Y, and 36Op of the printing head 130 includes a single head. Alternatively, each of the nozzle rows may include a plurality of heads or head chips. In this case, a test pattern for landing deviation detection formed by each of the heads or head chips may be used to detect landing deviation amounts of the transparent ink between the heads or between the head chips.

(B4) It is stated that in the printing apparatus 100 according to the above-described embodiment, the test printing medium Ts is used to detect a correction value and the correction value is stored into the memory 26. Regarding this, the printing apparatus may further perform, based on the printed data corrected by the correction processing, dot formation processing in which the correction of landing deviation is reflected. In such an aspect, dot data for printing obtained by halftone processing is adjusted by the correction value stored in the memory 26 in step S150, and ink dots are formed by using the corrected dot data. The printing medium Sh is used in the dot formation processing, and the replacement of the test printing medium Ts by the printing medium Sh may be performed automatically, or may be performed manually. In the printing apparatus according to such an aspect, landing deviations of the transparent ink can be efficiently corrected by using the imaging unit, and thus, it is possible to achieve high quality image recording.

(B5) In the printing apparatus 100 according to the above-described embodiment, the lightness component defined in the CIELab color space is used as lightness detected by the landing deviation correction unit 150. Alternatively, a brightness signal Y in the color space represented by YUV and YCb (Pb) Cr (Pr) components, or numbers assigned to a continuous change in color brightness from white to black may be used as lightness.

(B6) In the printing apparatus 100 according to the above-described embodiment, the absolute value of a calculated difference between the logarithmic function Log L1 for the lightness L1 and the logarithmic function Log L2 for the lightness L2 is exemplarily used as a lightness difference. Regarding this, the lightness difference is not limited to a calculated value based on logarithmic functions. As the lightness difference, any calculated value of difference, including calculated values of difference based on various lightness values such as lightness L defined in the CIELab color space described above, a lightness value represented by using a component in the YUV and YCb (Pb) Cr (Pr) color space, and the like, may be used. Further, the lightness difference is not limited to an absolute value, and may be a relative value.

(B7) In the printing apparatus 100 according to the above-described embodiment, a sand-matted vapor-deposited film is used for the test printing medium Ts. Alternatively, foil paper or a kneaded vapor-deposited film may be used for the test printing medium Ts.

C. Other Aspects

The present disclosure is not limited to the embodiments described above, and may be implemented in various aspects without departing from the spirit of the disclosure. For example, the present disclosure may be achieved through the following aspects. Appropriate replacements or combinations may be made to the technical features in the above-described embodiments which correspond to the technical features in the aspects described below to solve some or all of the problems of the disclosure or to achieve some or all of the advantageous effects of the disclosure. Additionally, when the technical features are not described herein as essential technical features, such technical features may be deleted appropriately.

(1) According to an aspect of the present disclosure, provided is a recording medium having a test pattern recorded thereon, the test pattern being used for acquiring a landing deviation amount in a recording apparatus including a discharge unit configured to discharge a transparent ink. In the recording medium, when light is radiated to be incident on a surface of the recording medium at an incident angle of 45 degrees, and lightness of reflected light from the test pattern recorded with the transparent ink and lightness of reflected light from the recording medium are measured, with each of the lightness being measured at a position perpendicular to the surface, a difference in lightness between the reflected light from the test pattern and the reflected light from the recording medium is equal to or greater than a predetermined value based on a type of the recording medium. In the recording medium according to this aspect, it is possible to obtain a difference in lightness that is equal to or greater than a predetermined value based on the type of the recording medium, when the lightness of the reflected light from the recording medium and the lightness of the reflected light from the test pattern on the recording medium are measured at a position perpendicular to the surface of the recording medium. Thus, an existing image scanner configured not to receive specularly reflected light can be used to recognize a position of the transparent ink on the recording medium. As a result, detection of the landing deviation amount can be automated by the image scanner, and fast calculation of a correction value can be achieved.

(2) In the recording medium according to this aspect, the lightness of the reflected light from the test pattern and the lightness of the reflected light from the recording medium may be lightness defined in a Lab color space. In the recording medium according to this aspect, lightness defined in the known standard can be used to determine whether a recording medium can be used for recognition of a position of the transparent ink by using an existing image scanner.

(3) In the recording medium according to this aspect, when L1 is the lightness of the reflected light from the test pattern, and L2 is the lightness of the reflected light from the recording medium and the difference in lightness is an absolute value of a difference between a logarithmic function Log L1 and a logarithmic function Log L2, the predetermined value may be 0.007. The recording medium according to this aspect includes, for example, foil paper, a kneaded vapor-deposited film, or a sand-matted vapor-deposited film. These recording media can be used to recognize a position of the transparent ink on the recording medium by an existing image scanner.

(4) According to another aspect of the present disclosure, provided is a method for acquiring a landing deviation amount of a recording apparatus including a first discharge unit configured to discharge a colored ink and a second discharge unit configured to discharge a transparent ink. The method for acquiring a landing deviation amount of a recording apparatus includes, recording a first pattern formed of the colored ink and a second pattern formed of the transparent ink in a superposed manner onto a recording medium made from a vapor-deposited film or foil paper, thereby forming a test pattern, irradiating the recording medium with light and receiving reflected light from the test pattern, thereby detecting the test pattern, and detecting a landing deviation amount based on a relative positional relationship in the detected test pattern.

(5) In the method for acquiring a landing deviation amount in a recording apparatus according to the aspect, when the recording medium is a vapor-deposited film, the vapor-deposited film is a sand-matted vapor-deposited film or a kneaded vapor-deposited film. In the method for acquiring a landing deviation amount in a recording apparatus according to the aspect, a recording medium having a greater lightness difference can be used to detect landing deviation amounts.

The present disclosure may be embodied in various forms other than the recording apparatus. For example, the present disclosure can be embodied in many forms including a manufacturing method of the recording apparatus, a control method of the recording apparatus, a recording method, a recording system including an encoding device and the recording apparatus, a computer program for implementing the recited apparatus, method, or system, and a non-transitory storage medium for storing the computer program.

What is claimed is:

1. A recording medium having a test pattern recorded, the test pattern being used for acquiring a landing deviation amount of a recording apparatus including a discharge unit configured to discharge a transparent ink, the recording medium comprising:

a first area in which the test pattern is recorded with at least the transparent ink; and a second area in which the test pattern is not recorded and that is different from the first area, the recording medium having a lightness difference between the first area and the second area, the lightness difference being equal to or greater than a value predetermined based on a type of the recording medium, the light difference being defined as a difference in lightness between a reflected light from the test pattern recorded with the transparent ink in the first area and a reflected light from the recording medium in the second area when light is radiated to be incident on a surface of the recording medium at an incident angle of 45 degrees, and lightness of the reflected light from the test pattern recorded with the transparent ink in the first area and lightness of the reflected light from the recording medium in the second area are measured, with each of the lightness being measured at a position perpendicular to the surface, wherein the recording medium has the lightness difference equal to or greater than 0.007 as the predetermined value, when L1 is the lightness of the reflected light from the test pattern recorded with the transparent ink in the first area and L2 is the lightness of the reflected light from the recording medium in the second area, and the difference in lightness is an absolute value of a difference between a logarithmic function LogL1 and a logarithmic function LogL2.

2. The recording medium according to claim 1, wherein the recording medium has the lightness difference defined as the difference in the lightness defined in a Lab color space between the reflected light from the test pattern recorded with the transparent ink in the first area and the reflected light from the recording medium in the second area.

3. The recording medium according to claim 1, wherein the recording medium is a foil paper, a kneaded vapor-deposited film, or a sand-matted vapor-deposited film.

4. The recording medium having a test pattern recorded, the test pattern being used for acquiring a landing deviation amount of a recording apparatus including a discharge unit configured to discharge a transparent ink, the recording medium comprising:

a first area in which the test pattern is recorded with at least the transparent ink; and a second area in which the test pattern is not recorded and that is different from the first area, the recording medium having a lightness difference between the first area and the second area, the lightness difference being equal to or greater than a value predetermined based on a type of the recording medium, the light difference being defined as a difference in lightness between a reflected light from the test pattern recorded with the transparent ink in the first area and a reflected light from the recording medium in the second area when light is radiated to be incident on a surface of the recording medium at an incident angle of 45 degrees, and lightness of the reflected light from the test pattern recorded with the transparent ink in the first area and lightness of the reflected light from the recording medium in the second area are measured, with each of the lightness being measured at a position perpendicular to the surface, wherein the test pattern includes a plurality of ruled lines recorded with the transparent ink, and a plurality of rules line pairs, each ruled line has a lateral width substantially equal to a gap distance between each ruled line pair, and the plurality of ruled lines are positioned corresponding to at least one of the plurality of ruled line pairs such that each ruled line has a stepwisely different spacing to a corresponding ruled line pair.

* * * * *